United States Patent [19]

Kropp

[11] 4,413,650

[45] Nov. 8, 1983

[54] HYDRAULIC SPOOL VALVES WITH CONTROLLED BY-PASS

[75] Inventor: Walter Kropp, Aschaffenburg, Fed. Rep. of Germany

[73] Assignee: Linde Aktiengesellschaft, Hollriegelskreuth, Fed. Rep. of Germany

[21] Appl. No.: 257,148

[22] Filed: Apr. 24, 1981

[30] Foreign Application Priority Data

Apr. 29, 1980 [DE] Fed. Rep. of Germany ..... 3016533

[51] Int. Cl.[3] ..... F15B 13/04

[52] U.S. Cl. ..... 137/596.13; 137/625.68

[58] Field of Search ..... 137/596.13, 625.68

[56] References Cited

U.S. PATENT DOCUMENTS 4,117,862 10/1978 Qureshi ..... 137/596.13

*Primary Examiner*—Gerald A. Michalsky

*Attorney, Agent, or Firm*—Buell, Blenko, Ziesenheim & Beck

[57] ABSTRACT

A hydraulic spool valve is provided for controlling the flow of fluid between a pump, a consumer of hydraulic energy and a reservoir which spool has pressure controlled by-pass means by-passing fluid from the fluid inlet of the valve to tank while the valve is moving from a neutral to a work position and the reverse thereof at a pre-selected pressure level.

3 Claims, 1 Drawing Figure

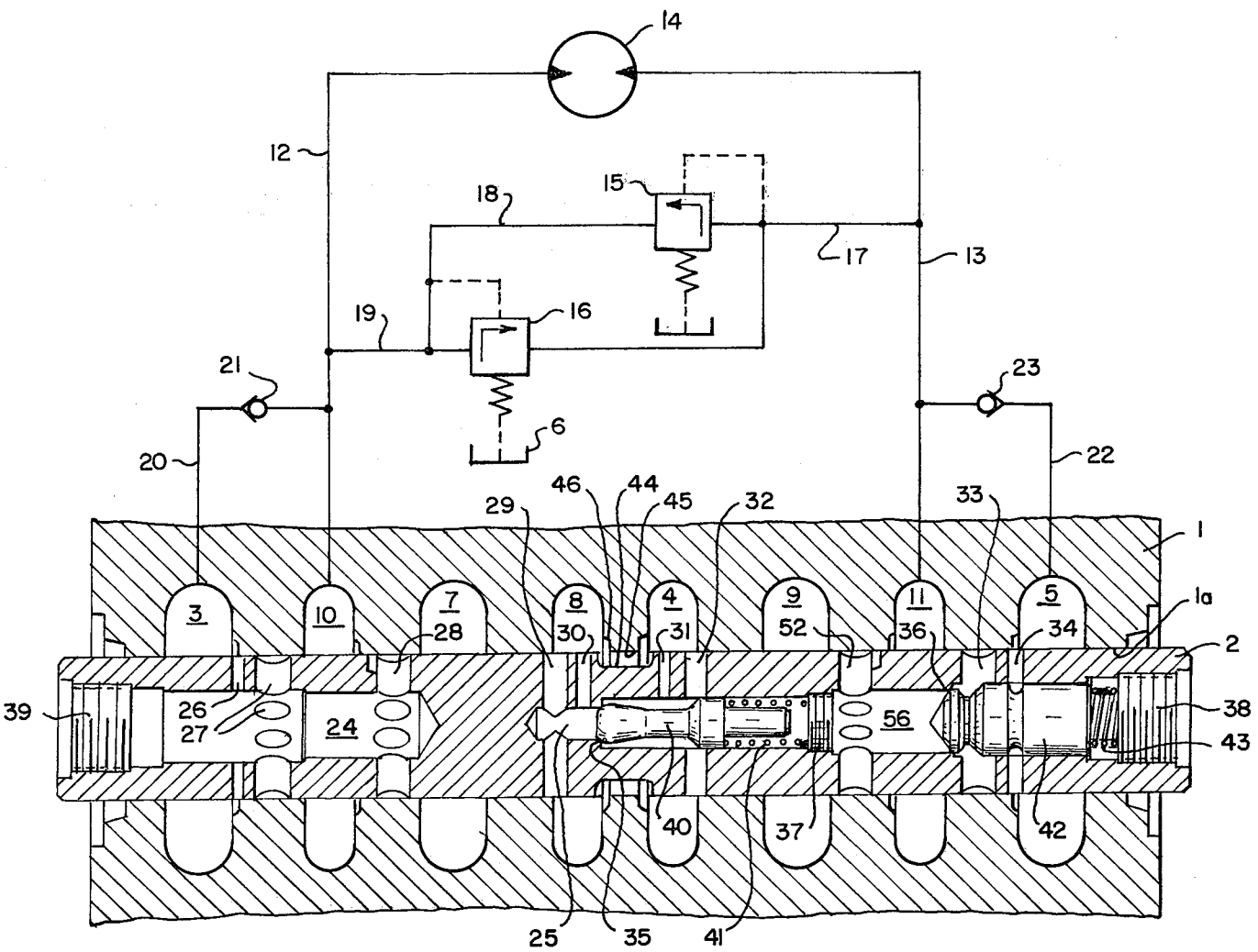
1
1a
2
38
43
22
23
5
34
42
33
13
11
36
56
17
9
52
37
32
41
14
15
4
31
40
45
44
35
46
16
6
8
30
25
29
18
7
28
19
10
24
12
21
26
27
3
20
39

HYDRAULIC SPOOL VALVES WITH CONTROLLED BY-PASS

This invention relates to valves and particularly to hydraulic spool valves having pressure controlled by-pass means capable of by-passing fluid from the fluid inlet of the valve to tank while the valve is moving from a neutral to a work position and the reverse thereof at a pre-selected pressure level.

Hydraulic spool valves for controlling the flow of fluid from a pressure fluid source to a consumer of fluid pressure energy and to a non-pressurized reservoir are well known. It is known to provide restrictors or a restrictor in such valves so that when the spool leaves the neutral position toward a work position, a large flow of fluid is not too suddenly fed by the source of pressure fluid, for example, a pump, to the energy consumer, for example a motor, but rather a small flow passes through the restrictors until an increasingly large flow and finally the full flow is applied to the energy consumer as the spool is moved fully to the work position. Such restrictors are sometimes called "precision control grooves". If the spool is now returned to the neutral position, the restrictors again come into play with the result that a portion of the pump or inlet flow runs off through the restrictors to reservoir, while the balance is fed to the opposite side of the consumer. However, on the opposite side of the spool when it is moved from neutral the full discharge area of the work chamber is open to flow to the reservoir so that the full stream from the energy consumer can drain off to the reservoir without restriction. Since the consumer is, in many cases acting as a brake on the system, this results in a lack of failure to fill the input side of the consumer, i.e. the consumer can move more rapidly than the oil can flow in resulting in foaming and cavitation, which can damage the mechanical parts of the energy consumer.

The present invention proposes to eliminate this shortcoming of prior art valves and provides a valve in which pressure medium flows from the pump to the drain through the restrictors only during certain operating states in which it is desired, while such an outflow is prevented if it would cause a filling deficiency, and the resulting foaming and cavitation.

Based on the knowledge that there is a different pressure potential at the restrictors when outflow through the latter is desired than when this outflow is not desired, a pressure-dependent valve that opens only when a pressure exceeding a limiting pressure is present and that controls the throughflow through the restrictor or restrictors is provided for solving the problem according to the present invention.

I provide a valve for controlling the flow of fluid between a pump, a consumer of hydraulic energy and a reservoir comprising a housing, a spool slidable longitudinally in a bore in said housing, a plurality of spaced chambers in the housing surrounding the bore and spool and arranged so that connections from the housing to the energy consumer are selectively closed off in one position of the spool and the pump is directly connected to the reservoir through at least one restrictor and in an adjacent work position of the spool the pump is connected directly to one side of an energy consumer and to said reservoir selectively through one restrictor and the other side of said energy consumer is directly connected to said reservoir and a pressure control valve in said restrictor controlling flow therethrough in said work position dependant upon pressure therein. Preferably the pressure control valve is set to open only when a predetermined pressure is reached in the connection from the pump to the energy consumer. The restrictor in the valve spool is preferably a pair of spaced radial bores which form narrow restrictors extending from the exterior of the spool to an axial bore in the spool and in part selectively connect the pump and reservoir in the work position.

In the foregoing general description of my invention I have set out certain objects, purposes and advantages of this invention. Other objects, purposes and advantages of this invention will be apparent from a consideration of the following description and the accompanying drawing showing a longitudinal schematic drawing of a valve according to my invention connected to a hydraulic energy consumer.

Referring to the drawing there is illustrated a housing 1 having a bore 1*a* in which an elongate cylindrical longitudinally sliding spool 2 is provided for lengthwise movement. In the housing 1 are provided chambers which communicate with the bore in the form of annular recesses. Three of such spaced chambers 3, 4 and 5 are connected to a reservoir 6 by means of a drain line, not shown, but common in all such valve structures. Spaced chambers 7, 8 and 9 are connected to a hydraulic pump, not shown, by pressure lines in conventional manner. Spaced chambers 10 and 11 are connected through lines 12 and 13 with a hydraulic motor 14. In order to protect the hydraulic motor 14 against excessively high pressure, pressure limiting valves 15 and 16, which are set at a pressure that is permissible for the hydraulic motor 14, are connected to lines 12 and 13. This means that if the maximum admissible pressure in line 13 is exceeded, this pressure is communicated through line 17 to the pressure-limiting valve 15 so that it opens and pressure medium flows from line 13 through line 17 of the pressure-limiting valve 15 and line 18 into line 19, which connects line 12 with the pressure-limiting valve 16.

Chamber 3 is connected with line 12 through a resuction 20, in which there is a resuction check valve 21, and chamber 5 is connected in a similar manner with line 13 through a line 22, in which there is a resuction check valve 23.

Longitudinal bores 24, 25 and 56 are provided in the longitudinal slide spool 2, coaxially to fit it, as well as radial bores, of which the radial bores 26, 27 and 28 empty into the longitudinal bore 24 and the radial bores 29, 30, 31 and 32 empty into the longitudinal bore 25 and the radial bores 52, 33 and 34 empty into longitudinal bore 56. Longitudinal bore 25 is recessed, such that a shoulder 35 is formed in it, which serves as a valve seat, and bore 56 is also recessed so that a shoulder 36 is formed in it, which also forms a valve seat.

For reasons of production technique, the bores 25 and 56 are produced as one bore passing all the way through and is divided by a stopper 37 into the two bores 25 and 26. Bore 56 in turn is closed off by a plug 38 and bore 24, by a plug 39.

In bore 25 a valve body 40 is capable of moving between the shoulder 35 and the stopper 37 against the force of spring 41, in which case this valve body 40 with a conical surface can lie against the shoulder 35 in a sealing manner.

In bore 56 a valve body 42 is also capable of moving against the force of a spring 43. This valve body is not of interest, however, in relation to the present invention. Thus, a similar valve body located in the bore 24 symmetrically to the valve body 42 is not designated.

There is also an annular groove 44 around the slide spool 2.

The radial bores 30 and 31 are designed as restrictors.

The mode of operation is as follows: In the neutral position of the slide spool 2, as shown in the diagram, the chamber 8 is connected through the annular groove 44 with the chamber 4 so that the full feed flow of the pump passes over this path through chamber 4 to a pressureless reservoir 6.

If the slide spool 2 is now displaced a little to the left in the diagram, the right-hand edge of the annular groove 44 in the diagram makes contact with the edge 45 (moved back somewhat for the sake of precise treatment) of the housing 1 so that further drainage through the annular groove 44 is no longer possible. The mouth of the bore 29 through the housing 1, namely, through the wall of the bore in which the slide spool 2 is capable of sliding, is likewise closed off. The full pressure of the pump prevails through chamber 8 and the radial bore 30 forming a restrictor in the left-hand part of the bore 25 in front of the face of valve body 40 and presses the latter against the force of spring 41 toward the right in the diagram so that a small portion of the pressure medium flow supplied by the pump can flow off through chamber 8 through the radial bore 30, the longitudinal bore 25, and the radial bores 31 and 32 into chamber 4. At the same time, the radial bore 52 becomes connected with chamber 9 and radial bore 33 becomes connected with chamber 11 so that most of the pressure medium flow supplied by the pump flows through chamber 9, the radial bores 52, the longitudinal bore 56, and the radial bores 33 into chamber 11 and from this through line 13 to the hydraulic motor 14. At the same time, the radial bore 28 is connected with chamber 10 and the radial bore 27 with chamber 3 so that the pressure medium flowing out from the hydraulic motor 14 passes through line 12, chamber 10, radial bore 28, longitudinal bore 24, radial bore 27, and chamber 3 to the reservoir 6. With increasing displacement of the longitudinal slide spool 2 toward the left in the diagram, the bores 31 and 30 also become covered by the wall of housing 1 so that all connection between chambers 8 and 4 is interrupted and the pressure medium can flow from the pump only over chambers 9 and 11 through line 13 to the consumer, while a drainage from chamber 8 directly to chamber 4 is suppressed.

If the slide spool 2 is now displaced from the position last described, again in the direction to its neutral position shown in the diagram toward the right, the radial bore 30 again becomes connected with chamber 8 and the radial bore 31 with chamber 4. However, because the hydraulic motor 14 is no longer driven, but is in braking operation, only a slight pressure prevails in line 13. This pressure is also communicated over the said path through chambers 11 and 9 to the feed line of the pump, with the result that there is only a slight pressure in chamber 8 also. This slight pressure is insufficient to displace the valve body 40 against the force of the spring 41 toward the right in the drawing. Consequently, in this operating state no pressure medium flows from chamber 8 through radial bore 30 and longitudinal bore 25 and radial bore 31 to chamber 4. Rather the full stream supplied by the pump flows through chambers 9 and 11 and line 13 to the hydraulic motor 14.

The force of spring 41 can for example be adjusted so that the valve body 40 with its conical face is lifted from the shoulder 25 if a pressure of bar 25 is present in the left-hand portion of bore 25.

The same effect occurs in principle if the sliding spool 2 is displaced toward the right in the diagram, the only difference being that now the pressure medium flows from chamber 7 to chamber 10 and through line 12 to the hydraulic motor 14 and from the latter through line 13 and through chamber 11 flows off to chamber 5. Because chamber 8 is always connected with the pump and chamber 4 with the drain, only one valve body 40, which is capable of moving in one direction, needs to be provided. With a small displacement of the sliding spool 2 from the neutral position to the left, however, the radial bore 29 is very quickly closed, while radial bores 31 and 32 are open, so that the restrictor 30 lies in the direction of flow in front of the longitudinal bore 25 with the valve body 40, while with a displacement in the other direction the radial bores 29 and 30 are connected with chamber 8 and radial bores 32 are closed, so that the radial bore 31 forming a restrictor lies in the direction of flow behind the longitudinal bore 25 and the valve body 40.

In the foregoing specification I have set out certain preferred practices and embodiments of this invention, however, it will be understood that this invention may be otherwise embodied within the scope of the following claims.

I claim:

1. A valve for controlling the flow of fluid between a pump, a consumer of hydraulic energy and a reservoir comprising a housing having a bore, a spool slidable in said bore, said spool having a fluid by-pass including at least one restrictor passage therein, a plurality of spaced chambers in said housing surrounding the bore and spool, connections from two of said chambers to opposite sides of consumer of hydraulic energy, a connection from at least a third and fourth one of said plurality of chambers to a pump and a connection from at least a fifth one of said plurality of chambers to a reservoir, said chambers and spool being arranged so that in a first position said two chambers having a connection to the energy consumer are selectively closed and the pump is directly connected to the reservoir through said third and fifth chambers, through said fluid by-pass in the spool, and in a second position of the spool the said fourth chamber connected to the pump is connected to one of said two chambers connected to the energy consumer and in an intermediate position between said first and second position the said third chamber is connected to said reservoir through said at least one restrictor in the spool and through the fifth chamber, said fluid by-pass having an adjustable pressure control valve controlling the flow therethrough and through the restrictor passage.

2. A valve as claimed in claim 1 wherein the adjustable pressure control valve in the restrictor is set to open upon a predetermined pressure being reached in the fluid passing from the pump connected chamber to the energy consumer connected chamber receiving fluid from the pump.

3. A valve as claimed in claim 1 or 2 wherein the restrictor is a pair of radial bores in the spool which form narrow restrictor passages extending from the exterior of the bore to an axial bore in the spool and in part selectively connected to the pump and reservoir in the second position.

* * * * *